US011399250B2

(12) United States Patent
Chen et al.

(10) Patent No.: US 11,399,250 B2
(45) Date of Patent: Jul. 26, 2022

(54) DIGITAL AUDIO ARRAY CIRCUIT

(71) Applicant: Silicon Integrated Systems Corp., Hsinchu (TW)

(72) Inventors: Han-Ning Chen, Hsinchu (TW); Chien-Yu Chiang, Hsinchu (TW)

(73) Assignee: Silicon Integrated Systems Corp., Hsinchu (TW)

( * ) Notice: Subject to any disclaimer, the term of this patent is extended or adjusted under 35 U.S.C. 154(b) by 0 days.

(21) Appl. No.: 17/237,259

(22) Filed: Apr. 22, 2021

(65) Prior Publication Data

US 2021/0337337 A1 Oct. 28, 2021

(30) Foreign Application Priority Data

Apr. 24, 2020 (TW) ..... 109113941

(51) Int. Cl.
*H04S 7/00* (2006.01)
*H04S 1/00* (2006.01)
*H04R 5/04* (2006.01)

(52) U.S. Cl.
CPC ..... *H04S 7/30* (2013.01); *H04R 5/04* (2013.01); *H04S 1/007* (2013.01)

(58) Field of Classification Search
None
See application file for complete search history.

(56) References Cited

U.S. PATENT DOCUMENTS

| | | | | |
|---|---|---|---|---|
| 6,105,119 | A | 8/2000 | Kerr et al. | |
| 6,658,310 | B1 * | 12/2003 | Kamiya | G11B 20/10527 381/1 |
| 9,164,724 | B2 | 10/2015 | Maling, III et al. | |
| 9,668,081 | B1 | 5/2017 | Chen et al. | |
| 9,961,656 | B2 * | 5/2018 | Daley | H04W 56/0065 |
| 10,411,822 | B2 * | 9/2019 | Felder | H03F 3/20 |
| 10,602,257 | B1 * | 3/2020 | Okuda | G10K 11/17873 |
| 2018/0310047 | A1 | 10/2018 | Duan | |
| 2020/0092024 | A1 * | 3/2020 | Williams | H04L 65/80 |

FOREIGN PATENT DOCUMENTS

| | | | |
|---|---|---|---|
| CN | 103957055 | A | 7/2014 |
| CN | 204406122 | U | 6/2015 |
| CN | 105261365 | A | 1/2016 |
| CN | 10637582 | A | 2/2017 |
| CN | 109039335 | A | 12/2018 |
| JP | 2020005052 | A | 1/2020 |
| TW | 201316251 | A | 4/2013 |
| TW | 201735662 | A | 10/2017 |

* cited by examiner

*Primary Examiner* — Paul W Huber
(74) *Attorney, Agent, or Firm* — Mark M. Friedman

(57) ABSTRACT

A digital audio array circuit is provided. The digital audio array circuit includes at least two digital audio units and a system master unit. Each of the digital audio units is configured to transform a received sound wave to a digital audio signal. Each of the digital audio units includes a left/right channel configuration input terminal. The system master unit is connected to the at least two digital audio units in time division multiplexing to receive the digital audio signals. The left/right channel configuration input terminal of each of the digital audio units is configured to receive a same synchronizing signal.

10 Claims, 3 Drawing Sheets

DIGITAL AUDIO ARRAY CIRCUIT

FIELD OF INVENTION

The present invention relates to the field of an audio circuit, and in particular, to a digital audio array circuit.

BACKGROUND OF INVENTION

Currently, there are a variety of audio transmission interfaces for digital microphones (DMICs) on the market. Common audio transmission interfaces include inter-chip audio transmission (Inter-IC Sound, I2S), time division multiplexing (TDM), and other DMIC audio transmission interfaces.

An I2S audio transmission protocol uses two audio chips to divide audio data into two sets of left and right channels for data transmission in a sequence. Because the two audio chips receive a word selection signal at a same time, sound wave sampling of the two audio chips can be synchronized, which is conducive to subsequent noise reduction processing and other procedures. However, if more audio chips need to be set to achieve better audio reception, the I2S audio transmission protocol must configure a processing unit or a decoder for every two audio chips to provide word selection signals, which causes costs and volume increase.

With a TDM audio transmission protocol, multiple audio chips can be connected in series, making it easier to form an audio chip array circuit. There is no need to set up multiple processing units or decoders like the I2S audio transmission protocol. However, each audio chip of the TDM audio transmission protocol is sampled with a time offset, which is not conducive to the subsequent processing of the signal by noise reduction algorithms.

TECHNICAL SOLUTION

In order to solve the above technical problem, an objective of the present invention is to provide a digital audio array circuit to solve the time offset problem of TDM audio sampling.

In order to achieve the above objective, the present invention provides a digital audio array circuit comprising at least two digital audio units and a system master unit. Each of the digital audio units is adapted to convert a received sound wave into a digital audio signal, and each of the digital audio units comprises a left/right channel configuration input terminal. The system master unit is connected to the at least two digital audio units and configured to control the at least two digital audio units and to receive the digital audio signals of the at least two digital audio units. Wherein the system master unit is connected to the at least two digital audio units in time division multiplexing, and the left/right channel configuration input terminal of each of the digital audio units is configured to receive a same synchronization signal.

In the digital audio array circuit of an embodiment of the present invention, further comprises a synchronization signal line, wherein the system master unit further comprises a synchronization signal output terminal, and the synchronization signal line is electrically connected to the synchronization signal output terminal and the left/right channel configuration input terminal of each of the digital audio units.

In the digital audio array circuit of the embodiment of the present invention, wherein the system master unit further comprises a word selection signal terminal, and each of the digital audio units comprises a word selection signal input terminal and a word selection signal output terminal.

In the digital audio array circuit of the embodiment of the present invention, wherein the word selection signal terminal of the system master unit is electrically connected to the word selection signal input terminal of one of the digital audio units, and the word selection signal output terminal of the digital audio unit is electrically connected to the word selection signal input terminal of another one of the digital audio units.

In the digital audio array circuit of the embodiment of the present invention, wherein each of the digital audio units comprises a program to recognize whether a signal received by the left/right channel configuration input terminal is the synchronization signal.

In the digital audio array circuit of the embodiment of the present invention, wherein if each of the digital audio units recognizes that the signal received by the left/right channel configuration input terminal is the synchronous signal, each of the digital audio units performs sound wave sampling synchronously; if not, each of the digital audio units performs sound wave sampling according to the signal received by its word selection signal input terminal In the digital audio array circuit of the embodiment of the present invention, wherein the synchronization signal output terminal is a word selection signal terminal of the system master unit, and each of the digital audio units comprises a word selection signal input terminal and a word selection signal output terminal.

In the digital audio array circuit of the embodiment of the present invention, wherein the word selection signal terminal of the system master unit is electrically connected to the word selection signal input terminal of one of the digital audio units, the word selection signal output terminal of the digital audio unit is electrically connected to the word selection signal input terminal of another one of the digital audio units, and the synchronization signal line is electrically connected to the word selection signal terminal and the left/right channel configuration input terminal of each of the digital audio units.

In the digital audio array circuit of the embodiment of the present invention, wherein each of the digital audio units comprises a program to recognize whether a signal received by the left/right channel configuration input terminal is the synchronization signal.

In the digital audio array circuit of the embodiment of the present invention, wherein if each of the digital audio units recognizes that the signal received by the left/right channel configuration input terminal is the synchronous signal, each of the digital audio units performs sound wave sampling synchronously; if not, each of the digital audio units performs sound wave sampling according to the signal received by its word selection signal input terminal.

In the digital audio array circuit of the embodiment of the present invention, the left/right channel configuration input terminal of each of the digital audio units is configured to receive the same synchronization signal, and if each of the digital audio units recognizes that the signal received by the left/right channel configuration input terminal is the synchronous signal, each of the digital audio units performs sound wave sampling synchronously, which can reduce costs and circuit volume, and solve the time offset problem of TDM audio sampling.

DETAILED DESCRIPTION OF PREFERRED EMBODIMENTS

In order to make the above and other objectives, features, and advantages of the present invention more obvious and understandable, the following will specifically cite the preferred embodiments of the present invention, together with the accompanying drawings, and describe in detail as follows. Further, directional terms, such as upper, lower, top, bottom, front, rear, left, right, inner, outer, side, around, central, horizontal, vertical, axial, radial, uppermost, or lowermost, mentioned in the present invention are only for reference. Therefore, the directional terms are used for describing and understanding rather than limiting the present invention.

Figure 1:
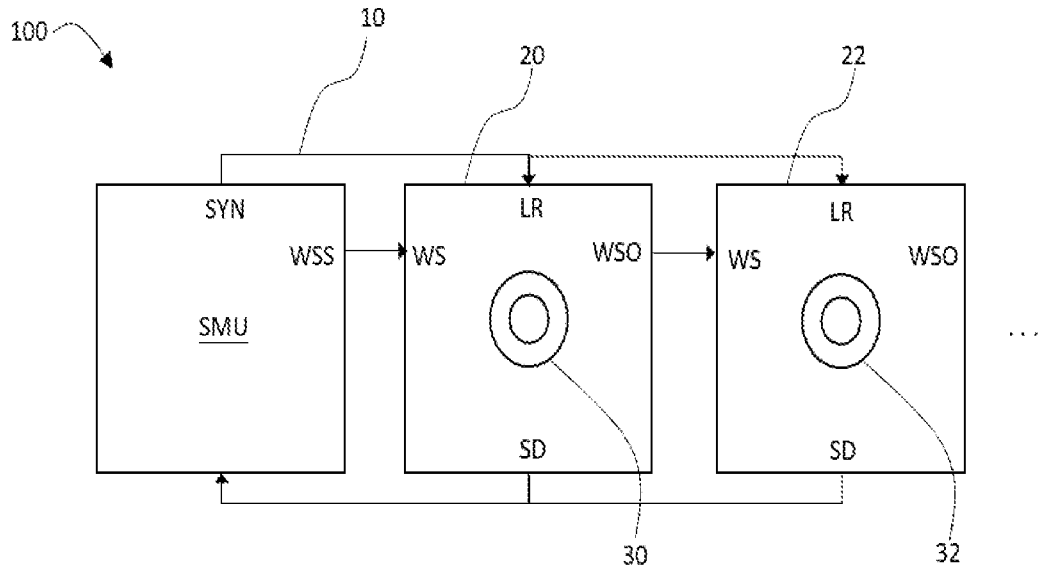
FIG. 1 is a schematic structural view of a digital audio array circuit according to an embodiment of the present invention.

Referring to FIG. 1, the present invention provides a digital audio array circuit 100, which comprises at least two digital audio units 20, 22 and a system master unit SMU. Each of the digital audio units is adapted to convert a received sound wave into a digital audio signal, and each of the digital audio units comprises a left/right channel configuration input terminal LR. The system master unit SMU is connected to the at least two digital audio units 20, 22 and is configured to control the at least two digital audio units 20, 22 and to receive the digital audio signals of the at least two digital audio units 20, 22. Wherein, the system master unit SMU is connected to the at least two digital audio units in time division multiplexing, and the left/right channel configuration input terminal LR of each of the digital audio units is configured to receive a same synchronization signal.

Specifically, each of the digital audio units further comprises an audio signal output terminal SD for transmitting the digital audio signal back to the system master unit SMU, a transmission method is, for example, in time division multiplexing (TDM) mode.

The digital audio array circuit 100 of an embodiment of the present invention further comprises a synchronization signal line 10. Wherein, the system master unit SMU further comprises a synchronization signal output terminal SYN, and the synchronization signal line 10 is electrically connected to the synchronization signal output terminal SYN and the left/right channel configuration input terminal LR of each of the digital audio units.

Specifically, the digital audio units 20, 22 can be TDM protocol audio chips, which comprise sound wave sensing components 30, 32, sampling components, analog-digital components (not shown), etc., to convert the received sound wave into digital audio signal. A number of the digital audio units range from 2 to 16.

Referring to FIG. 1, in the digital audio array circuit 100 of the embodiment of the present invention, the system master unit SMU further comprises a word selection signal terminal WSS, and each of the digital audio units comprises a word selection signal input terminal WS and a word selection signal output terminal WSO.

In the digital audio array circuit of the embodiment of the present invention, the word selection signal terminal WSS of the system master unit SMU is electrically connected to the word selection signal input terminal WS of one of the digital audio units 20, and the word selection signal output terminal WSO of the digital audio unit 20 is electrically connected to the word selection signal input terminal WS of another one of the digital audio units 22.

Figure 2:
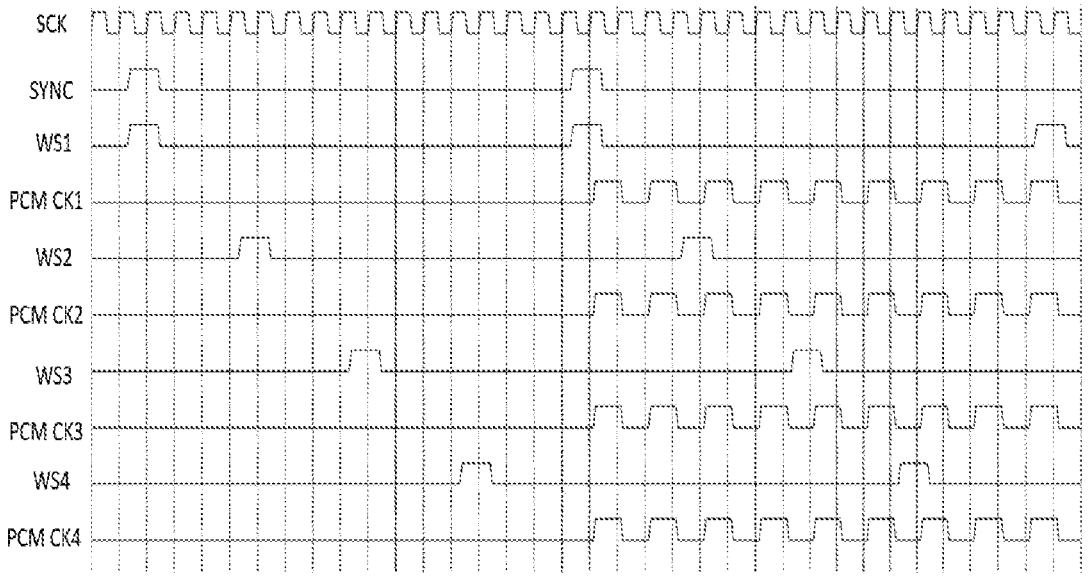
FIG. 2 is a schematic view of signal timing of the digital audio array circuit according to the embodiment of the present invention.

Referring to FIG. 2, specifically, a signal in which four digital audio units are connected in series is taken as an example. The system master unit will provide a clock signal SCK for each digital audio unit, and the synchronization signal is SYNC. A word selection signal of a first digital audio unit is WS1, and a sampling clock signal of pulse code modulation (PCM) is PCM CK1. A word selection signal of a second digital audio unit is WS2, and a sampling clock signal of PCM is PCM CK2. A word selection signal of a third digital audio unit is WS3, and a sampling clock signal of PCM is PCM CK3. A word selection signal of a fourth digital audio unit is WS4, and a sampling clock signal of PCM is PCM CK4. It can be seen from FIG. 2 that the word selection signals of different digital audio units have a time offset because the word selection signals are transmitted from one digital audio unit to another digital audio unit in order. If the sampling clock signal is triggered according to the word selection signal, there will be a problem of sampling time offset. As shown in FIG. 2, the present invention additionally disposes a synchronization signal SYNC to synchronize the sampling clock signals PCM CK1 to PCM CK4. Specifically, when the digital audio unit receives the first pulse of the synchronization signal SYNC, it starts a state machine. When the digital audio unit receives the second pulse of the synchronization signal SYNC, it synchronously starts the sampling clock signals PCM CK1 to PCM CK4.

Specifically, after the audio signal output terminal SD of each of the digital audio units receives a pulse signal at the word selection signal input terminal WS of the digital audio unit, it transmits the digital audio signal back to the system master unit SMU, and the transmission method is, for example, in TDM mode.

In the digital audio array circuit of the embodiment of the present invention, each of the digital audio units comprises a program to recognize whether a signal received by the left/right channel configuration input terminal is the synchronization signal. Specifically, when the signal received by the left/right channel configuration input terminal is high, it means that the digital audio unit is set to a right channel. When the signal received by the left/right channel configuration input terminal is low, it means that the digital audio unit is set to a left channel. Or when the signal received by the left/right channel configuration input terminal is high, it means that the digital audio unit is set to the left channel. When the signal received by the left/right channel configuration input terminal is low, it means that the digital audio unit is set to a right channel. The present invention is not limited thereof.

In the digital audio array circuit of the embodiment of the present invention, if each of the digital audio units recognizes that the signal received by the left/right channel configuration input terminal is the synchronous signal, each of the digital audio units performs sound wave sampling synchronously; if not, each of the digital audio units performs sound wave sampling according to the signal received by its word selection signal input terminal. Specifically, if the signal received by the left/right channel configuration input terminal is the pulse signal, an identification procedure of the digital audio unit will start to perform a synchronization operation of the sampling clock signal PCM CK.

Figure 3:
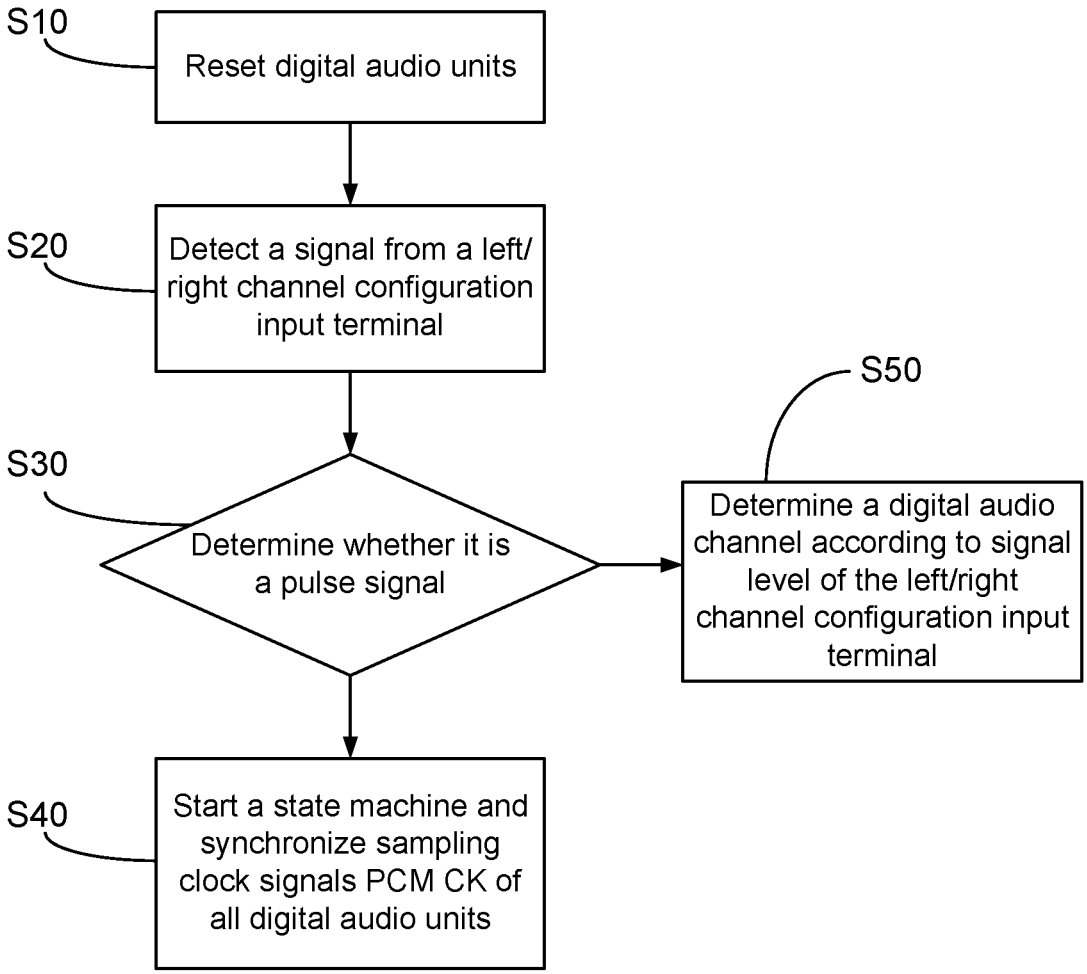
FIG. 3 is a flow chart of steps of identifying a synchronization signal according to the embodiment of the present invention.

Specifically, referring to FIG. 3, steps of identifying the synchronization signal include: Step S10: Reset the digital audio units; Step S20: Detect the signal from the left/right channel configuration input terminal; Step S30: Determine whether the signal is the pulse signal; If the signal is the pulse signal, perform step S40: Start the state machine and synchronize the sampling clock signals PCM CK of all digital audio units. If not, perform step S50: Determine the digital audio channel according to a signal level of the left/right channel configuration input terminal.

Figure 4:
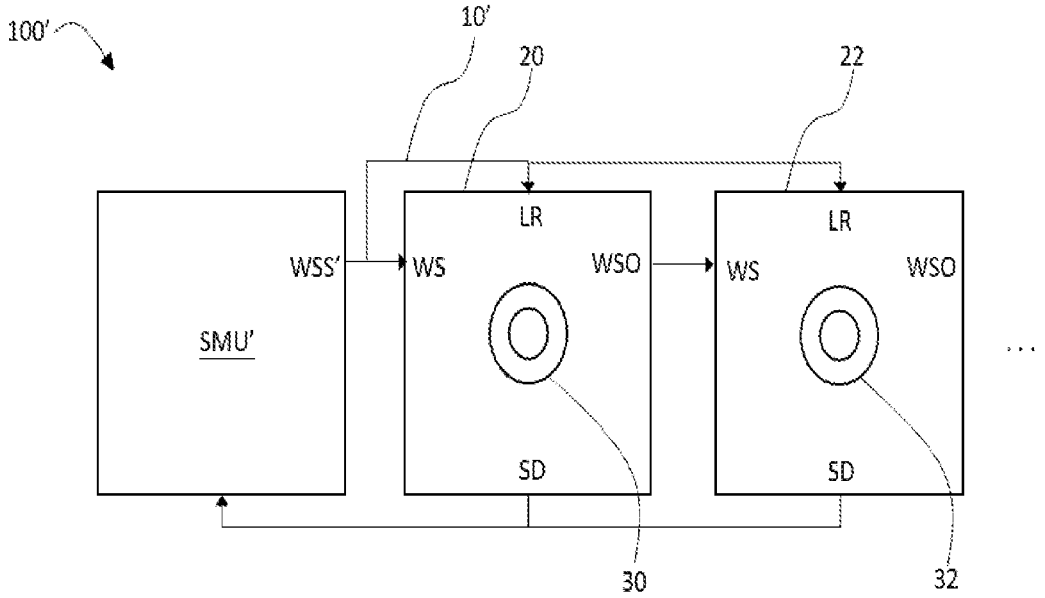
FIG. 4 is a schematic structural view of a digital audio array circuit according to another embodiment of the present invention.

Referring to FIG. 4, in a digital audio array circuit 100' of an embodiment of the present invention, the synchronization signal output terminal is a word selection signal terminal WSS' of a system master unit SMU', and each of the digital audio units comprises a word selection signal input terminal WS and a word selection signal output terminal WSO.

In the digital audio array circuit 100' of the embodiment of the present invention, the word selection signal terminal WSS' of the system master unit SMU' is electrically connected to the word selection signal input terminal WS of one of the digital audio units 20, a word selection signal output terminal WSO of the digital audio unit 20 is electrically connected to a word selection signal input terminal WS of another one of the digital audio units 22, and a synchronization signal line 10' is electrically connected to the word selection signal terminal WSS' and the left/right channel configuration input terminal LR of each of the digital audio units.

Figure 5:
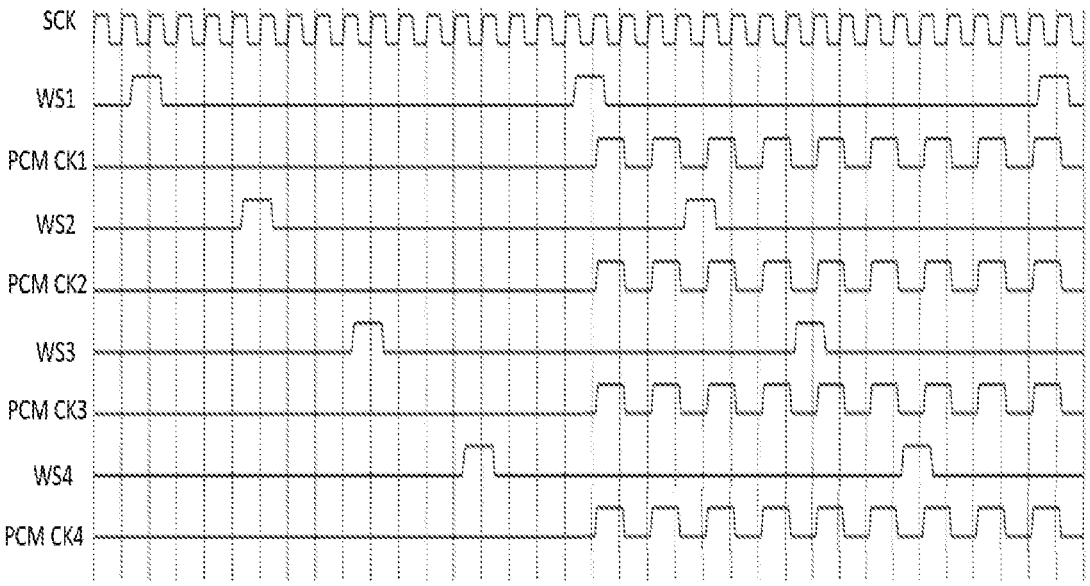
FIG. 5 is a schematic view of signal timing of the digital audio array circuit according to another embodiment of the present invention.

Referring to FIG. 5, specifically, a signal in which four digital audio units are connected in series is taken as an example. The system master unit will provide a clock signal SCK for each digital audio unit, and provide a word selection signal WS1 for a first digital audio unit. Meanwhile, the word selection signal WS1 is also used as the synchronization signal for all digital audio units. A word selection signal of the first digital audio unit is WS1, and a sampling clock signal of PCM is PCM CK1. A word selection signal of a second digital audio unit is WS2, and a sampling clock signal of PCM is PCM CK2. A word selection signal of a third digital audio unit is WS3, and a sampling clock signal of PCM is PCM CK3. A word selection signal of a fourth digital audio unit is WS4, and a sampling clock signal of PCM is PCM CK4. It can be seen from FIG. 5 that the word selection signals of different digital audio units have a time offset because the word selection signals are transmitted from one digital audio unit to another digital audio unit in order. If the sampling clock signal is triggered according to the word selection signal, there will be a problem of sampling time offset. As shown in FIG. 5, the present invention uses the synchronization signal line 10' to provide the word selection signal WS1 to the left/right channel configuration input terminal LR of all audio units as the synchronization signal of all digital audio units, which can synchronize the sampling clock signals PCM CK1 to PCM CK4. Specifically, when the digital audio unit receives the first pulse of the word selection signal WS1, it starts a state machine. When the digital audio unit receives the second pulse of the word selection signal WS1, it synchronously starts the sampling clock signals PCM CK1 to PCM CK4.

In the digital audio array circuit of the embodiment of the present invention, wherein each of the digital audio units comprises a program to recognize whether a signal received by the left/right channel configuration input terminal is the synchronization signal. Specifically, steps of identifying the synchronization signal are similar to the above-mentioned embodiment. Please refer to FIG. 3 and the above description, and the steps will not be repeated here.

In the digital audio array circuit of the embodiment of the present invention, the left/right channel configuration input terminal of each of the digital audio units is configured to receive the same synchronization signal, and if each of the digital audio units recognizes that the signal received by the left/right channel configuration input terminal is the synchronous signal, each of the digital audio units performs sound wave sampling synchronously, which can reduce costs and circuit volume, and solve the time offset problem of TDM audio sampling.

Although the present invention has been disclosed in preferred embodiments, it is not intended to limit the present invention. People skilled in the art can make various changes and modifications without departing from the spirit and scope of the present invention. Therefore, the scope of protection of the present invention shall be subject to the scope of the claims.

REFERENCE NUMERALS

10, 10' synchronization signal line
20 digital audio unit
22 digital audio unit
30 sound wave sensing component
32 sound wave sensing component
100, 100' digital audio array circuit
SMU, SMU' system master unit
SYN synchronization signal output terminal
LR left/right channel configuration input terminal
SD audio signal output terminal
WSS, WSS' word selection signal terminal
WS word selection signal input terminal
WSO word selection signal output terminal
SCK clock signal
SYNC synchronization signal
WS1, WS2, WS3, WS4 word selection signal
PCM CK1, PCM CK2, PCM CK3, PCM CK4 sampling clock signal
S10-S50 steps

What is claimed is:

1. A digital audio array circuit, comprising:

at least two digital audio units, wherein each of the digital audio units is adapted to convert a received sound wave into a digital audio signal, and each of the digital audio units comprises a left/right channel configuration input terminal; and a system master unit connected to the at least two digital audio units and configured to control the at least two digital audio units and to receive the digital audio signals of the at least two digital audio units;

wherein the system master unit is connected to the at least two digital audio units in time division multiplexing, and the left/right channel configuration input terminal of each of the digital audio units is configured to receive a same synchronization signal.

2. The digital audio array circuit according to claim 1, further comprising a synchronization signal line, wherein the system master unit further comprises a synchronization signal output terminal, and the synchronization signal line is electrically connected to the synchronization signal output terminal and the left/right channel configuration input terminal of each of the digital audio units.

3. The digital audio array circuit according to claim 2, wherein the system master unit further comprises a word selection signal terminal, and each of the digital audio units comprises a word selection signal input terminal and a word selection signal output terminal.

4. The digital audio array circuit according to claim 3, wherein the word selection signal terminal of the system master unit is electrically connected to the word selection signal input terminal of one of the digital audio units, and the word selection signal output terminal of the digital audio unit is electrically connected to the word selection signal input terminal of another one of the digital audio units.

5. The digital audio array circuit according to claim 4, wherein each of the digital audio units comprises a program to recognize whether a signal received by the left/right channel configuration input terminal is the synchronization signal.

6. The digital audio array circuit according to claim 5, wherein if each of the digital audio units recognizes that the signal received by the left/right channel configuration input terminal is the synchronous signal, each of the digital audio units performs sound wave sampling synchronously; if not, each of the digital audio units performs sound wave sampling according to the signal received by its word selection signal input terminal.

7. The digital audio array circuit according to claim 2, wherein the synchronization signal output terminal is a word selection signal terminal of the system master unit, and each of the digital audio units comprises a word selection signal input terminal and a word selection signal output terminal.

8. The digital audio array circuit according to claim 7, wherein the word selection signal terminal of the system master unit is electrically connected to the word selection signal input terminal of one of the digital audio units, the word selection signal output terminal of the digital audio unit is electrically connected to the word selection signal input terminal of another one of the digital audio units, and the synchronization signal line is electrically connected to the word selection signal terminal and the left/right channel configuration input terminal of each of the digital audio units.

9. The digital audio array circuit according to claim 8, wherein each of the digital audio units comprises a program to recognize whether a signal received by the left/right channel configuration input terminal is the synchronization signal.

10. The digital audio array circuit according to claim 9, wherein if each of the digital audio units recognizes that the signal received by the left/right channel configuration input terminal is the synchronous signal, each of the digital audio units performs sound wave sampling synchronously; if not, each of the digital audio units performs sound wave sampling according to the signal received by its word selection signal input terminal.

* * * * *